US010343268B2

(12) United States Patent
Hirabayashi et al.

(10) Patent No.: US 10,343,268 B2
(45) Date of Patent: Jul. 9, 2019

(54) ROTARY IMPACT TOOL

(71) Applicant: MAKITA CORPORATION, Anjo-shi, Aichi (JP)

(72) Inventors: Tokuo Hirabayashi, Anjo (JP); Ryunosuke Kumagai, Anjo (JP); Takeshi Nishimiya, Anjo (JP); Goshi Ishikawa, Anjo (JP); Takuya Kusakawa, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 718 days.

(21) Appl. No.: 14/406,045

(22) PCT Filed: Jun. 4, 2013

(86) PCT No.: PCT/JP2013/065501
§ 371 (c)(1),
(2) Date: Dec. 5, 2014

(87) PCT Pub. No.: WO2013/183650
PCT Pub. Date: Dec. 12, 2013

(65) Prior Publication Data

US 2015/0144365 A1 May 28, 2015

(30) Foreign Application Priority Data

Jun. 5, 2012 (JP) ..... 2012-128231

(51) Int. Cl.
*B25B 23/14* (2006.01)
*B25B 21/02* (2006.01)

(52) U.S. Cl.
CPC ..... *B25B 23/1405* (2013.01); *B25B 21/02* (2013.01)

(58) Field of Classification Search
CPC ..... B25B 21/02; B25B 23/1405
USPC ..... 173/176
See application file for complete search history.

(56) References Cited

U.S. PATENT DOCUMENTS

2002/0050364 A1 5/2002 Suzuki et al.
2003/0149508 A1* 8/2003 Watanabe ..... B25B 23/1405 700/168
2005/0109520 A1* 5/2005 Kawai ..... B25B 21/02 173/183
2006/0155582 A1* 7/2006 Brown ..... A61B 5/0002 705/3

(Continued)

FOREIGN PATENT DOCUMENTS

JP H10-151578 A 6/1998
JP 2001-260042 A 9/2001
JP 2010-207951 A 9/2010

OTHER PUBLICATIONS

Aug. 18, 2015 Office Action issued in Japanese Patent Application No. 2012-128231.

(Continued)

*Primary Examiner* — Chelsea E Stinson
(74) *Attorney, Agent, or Firm* — Oliff PLC

(57) ABSTRACT

A rotary impact tool according to one aspect of the present invention includes a motor, an impact mechanism, a drive unit, an impact detection unit, and a control unit. The control unit reduces a driving force for the motor caused by the drive unit when a count of impacts detected by the impact detection unit has reached a determination count set in advance, which is a value greater than one.

17 Claims, 13 Drawing Sheets

(56) References Cited

U.S. PATENT DOCUMENTS

2011/0030980 A1* 2/2011 Ho ..... B23B 45/008
173/1
2011/0315417 A1 12/2011 Matsunaga et al.

OTHER PUBLICATIONS

Jul. 2, 2013 Search Report issued in International Patent Application No. PCT/JP2013/065501.
Translation of Dec. 18, 2014 International Preliminary Report on Patentability issued in International Patent Application No. PCT/JP2013/065501.

* cited by examiner

ROTARY IMPACT TOOL

CROSS-REFERENCE TO RELATED APPLICATIONS

This international application claims the benefit of Japanese Patent Application No. 2012-128231 filed Jun. 5, 2012 in the Japan Patent Office, and the entire disclosure of Japanese Patent Application No. 2012-128231 is incorporated herein by reference.

TECHNICAL FIELD

The present invention relates to a rotary impact tool configured to be rotationally operated by a rotational force of a motor and to apply an impact force in a rotation direction thereof when a torque equal to or greater than a specified value is applied externally.

BACKGROUND ART

A rotary impact tool of this kind is provided with an impact mechanism including a hammer to be rotated by receiving a rotational force of a motor and an anvil to be rotated by receiving a rotational force of the hammer.

In the impact mechanism, when a torque equal to or greater than a specified value is applied externally to the anvil, the hammer comes off the anvil to rotate idle, and impacts the anvil in a rotation direction thereof.

Thus, according to the rotary impact tool, when fixing a screw to an object, the screw can be tightened firmly by the impact on the anvil by the hammer.

Furthermore, there is a known rotary impact tool that includes a sensor to detect an impact by the hammer and that is designed to switch the rotation speed of the motor from a normal speed to a low speed when the impact is detected by the sensor (see, for example, Patent Document 1 specified below).

According to such a technique described in Patent Document 1, it is possible to reduce an impact force caused by an impact that is to occur subsequently because the rotation speed of the motor (a driving force, in other words) is reduced when the impact is detected.

Therefore, according to the technique described in Patent Document 1, the impact force can be inhibited from being so excessive as to cause a screw head to be stripped or broken off during tightening of the screw with the rotary impact tool.

PRIOR ART DOCUMENTS

Patent Documents

Patent Document 1: Japanese Unexamined Patent Application Publication No. 2010-207951

SUMMARY OF THE INVENTION

Problems to be Solved by the Invention

Incidentally, in a rotary impact tool, application of a torque equal to or greater than a specified value to an anvil occurs not only when a screw head is brought into contact with an object and tightening by an impact of a hammer is required, but also during rotation of a drill screw, for example.

Specifically, the drill screw has a tip section of a drill-like shape, and subsequent to the tip section, a screw thread is provided that forms an internal thread in an object, while allowing the drill screw to screw into the internal screw.

Fixing of the drill screw to the object is performed through steps of: firstly drilling a hole in the object with the tip section of the drill screw by rotation of the drill screw (a hole drilling step); next forming the internal thread in the hole (an internal thread forming step); and then screwing the screw thread into the formed internal thread and tightening the drill screw (a tightening step).

Therefore, when fixing the drill screw to the object with the rotary impact tool, the torque equal to or greater than the specified value may be applied to the anvil to thereby cause an impact by the hammer to start not only in the last tightening step but also in the internal thread forming step to form the internal thread in the hole formed in the object, in some cases.

The impact started in the internal thread forming step is performed repeatedly until the formation of the internal thread in the hole in the object is finished. When the formation of the internal thread is finished, the torque equal to or greater than the specified value is no longer applied to the anvil and, thus, the impact is discontinued temporarily.

Subsequently, when the head of the drill screw is brought into contact with the object in the tightening step, the torque equal to or greater than the specified value is applied to the anvil and, thus, the impact by the hammer is resumed.

In contrast to this, in the rotary impact tool described in the above-mentioned Patent Document 1, when the impact by the hammer is started, a rotation speed of the motor is reduced immediately.

Thus, when the drill screw is fixed to the object using the rotary impact tool described in Patent Document 1, upon proceeding to the internal thread forming step, the rotation speed of the motor (a driving force, in other words) is reduced immediately, and the motor is rotated at a low speed thereafter until completion of tightening of the drill screw.

Therefore, according to the rotary impact tool described in the above-mentioned Patent Document 1, although tightening of the screw can be well performed by reducing the impact force by the hammer, the time required to fix the drill screw to the object may possibly be prolonged.

Specifically, when the drill screw is rotated with the rotary impact tool to form the internal thread in the object, it is not necessary to reduce the impact force because the internal thread can be formed by the impact force of the hammer.

However, according to the rotary impact tool described in Patent Document 1, when the impact by the hammer is detected in the internal thread forming step, the rotation speed of the motor is reduced immediately and, thus, the time required to form the internal thread in the object in the internal thread forming step is prolonged.

Moreover, after the internal thread is formed in the object, the rotation speed of the motor until the head of the drill screw is brought into contact with the object and the impact by the hammer is resumed is also lower than that during normal operation and, thus, the time until such resumption is also prolonged.

As seen from the above, according to the rotary impact tool described in Patent Document 1, the time required to fix the drill screw to the object is prolonged and, thus, usability for a user may possibly be poor.

In one aspect of the present invention, it is preferred, in a rotary impact tool, that generation of an excessive impact force is inhibited by reducing a driving force for a motor during tightening of a screw and that an impact is caused to occur while inhibiting reduction of an impact force in the process of rotation prior to the tightening of the screw, such as during formation of an internal thread by a drill screw.

Means for Solving the Problems

A rotary impact tool of a first aspect includes a motor and an impact mechanism.

The impact mechanism includes a hammer to be rotated by a rotational force of the motor, an anvil to be rotated by receiving a rotational force of the hammer, and an attachment unit for attachment of a tool element to the anvil. When a torque equal to or greater than a specified value is applied externally to the anvil, the hammer comes off the anvil to rotate idle, and impacts the anvil in a rotation direction thereof.

The motor is driven by a drive unit in accordance with an external drive command, and an impact by the hammer in the impact mechanism is detected by an impact detection unit.

When a count of impacts detected by the impact detection unit has reached a determination count set in advance, which is a value greater than one, a control unit reduces a driving force for the motor caused by the drive unit.

In this way, according to the rotary impact tool of the present invention, when the count of impacts detected by the impact detection unit has reached the specified determination count (greater than one), the driving force for the motor caused by the drive unit is reduced to thereby reduce a rotation speed of the motor, which is not the case with the rotary impact tool described in Patent Document 1 in which, when an impact is detected by the impact detection unit, a rotation speed of the motor is reduced.

Therefore, according to the rotary impact tool of the present invention, in a case, for example, where a drill screw is fixed to an object, when a torque applied externally to the anvil is increased temporarily to cause an impact by the hammer to occur in an internal thread forming step or the like before a screw head is brought into contact with the object, the driving force for the motor can be inhibited from being reduced.

As a result, according to the rotary impact tool of the present invention, the time required to fix the drill screw to the object can be shortened compared with the rotary impact tool described in Patent Document 1, and thus, usability of the rotary impact tool for a user can be improved.

Moreover, according to the rotary impact tool of the present invention, when the impact by the hammer is performed more than once correspondingly to the determination count, the driving force for the motor is reduced.

Thus, when the head of the drill screw is brought into contact with the object and screw-tightening is required, the driving force for the motor can be reduced to thereby reduce the rotation speed of the motor.

In a case where a normal screw, not the drill screw, is to be fixed to the object, when a screw head is brought into contact with the object and screw-tightening is required, it is possible to reduce the driving force for the motor to thereby reduce the rotation speed of the motor, although such reduction is delayed by the impacts corresponding to the determination count.

As a result, according to the rotary impact tool of the present invention, it is possible to inhibit the screw head from being damaged due to excessive impact force applied to the screw head from the tool element.

Here, since the impact detection unit only has to detect the impact by the hammer, a rotary impact tool of a second aspect may be configured to detect a vibration or an impact sound generated when the hammer impacts the anvil.

Furthermore, when the hammer impacts the anvil, a load applied to the motor is once increased and, then, the load is reduced by an idle rotation of the hammer. Thus, rotation variation in the motor occurs, which causes changes in a current flowing through the motor, a voltage applied to the motor, a rotation speed of the motor, and so on.

Therefore, in the rotary impact tool of the second aspect, the impact detection unit detects such current, voltage, or the rotation speed.

The impact detection unit may be designed to detect one of these various physical quantities, or may be designed to selectively detect a plurality of physical quantities from among these various physical quantities.

When the impact detection unit is configured to detect at least one physical quantity selected from these various physical quantities, the control unit may be configured as described below.

Specifically, in the rotary impact tool of the second aspect, when the physical quantity detected by the impact detection unit varies either toward an increase or toward a decrease to respectively either exceed a threshold set in advance for impact determination or fall below a threshold set in advance for impact determination, the control unit determines that the hammer has impacted the anvil and counts the detected count of impacts.

Therefore, according to the rotary impact tool of the second aspect, the count of impacts by the hammer can be counted by the control unit, and when the count of impacts has reached the specified determination count, the driving force for the motor caused by the drive unit can be reduced to thereby reduce the rotation speed of the motor.

When the control unit is configured as such, the control unit may include a comparison circuit to compare the physical quantity detected by the impact detection unit with the threshold set in advance for impact determination and to output a determination signal when the physical quantity has exceeded the threshold, as in a rotary impact tool of a third aspect.

By adopting such a configuration, the control unit can easily counts the count of impacts because the control unit only has to count a count of outputs of the determination signal from the comparison circuit as the detected count of impacts.

Next, in the above-described drill screw, before the head of the drill screw is brought into contact with the object and screw-tightening is started, the torque applied externally to the anvil is increased temporarily to cause the impact on the anvil by the hammer to be performed. In such a case, a time period for such a temporary torque increase varies according to a thickness of the object.

Specifically, when the drill screw is rotated with the rotary impact tool, it is during a time period for forming an internal thread in the hole formed in the object that the impact by the hammer is performed before proceeding to a step of tightening the drill screw, and such a time period corresponds to a depth of the hole in which the internal thread is formed or the thickness of the object, in other words.

Therefore, a rotary impact tool of a fourth aspect includes an input unit to input the thickness of the object to be processed by a rotation of the tool element attached to the attachment unit.

In the rotary impact tool of the fourth aspect, a determination count setting unit sets the determination count based on the thickness of the object inputted by the input unit such that the thicker the thickness of the object is, the greater the value of the determination count is.

Specifically, such a configuration makes it possible to set a prohibition time period (corresponding to the determination count) in which reduction of the driving force for the motor is prohibited during occurrence of the impact by the hammer to a time period (corresponding to the thickness of the object) in which the internal thread is being formed with the drill screw.

Therefore, according to the rotary impact tool of the fourth aspect, when the drill screw is rotated to be tightened against the object, the rotation speed of the motor can be reduced approximately at the same time as start of tightening of the drill screw without occurrence of the above-described delay.

On the other hand, in a case where the impact detection unit is configured to detect at least one physical quantity selected from a vibration and an impact sound generated when the hammer impacts the anvil, a current and a voltage in the motor each varying according to the impact, the control unit may be configured as in a rotary impact tool of a fifth aspect.

Specifically, the impact on the anvil by the hammer occurs repeatedly due to the idle rotation of the hammer caused by the motor when the torque applied externally to the anvil is equal to or grater than the specified value. Thus, if the control unit is designed to detect a vibration or an impact sound during such a time period of the impact and to integrate the thus-detected vibration or impact sound, the integrated value is increased according to the count of impacts.

When the torque applied externally to the anvil is equal to or greater than the specified value and the hammer is rotated idle by the motor, a load applied to the motor is increased to thereby increase a current flowing through the motor compared with that during normal operation.

In addition, when the torque applied externally to the anvil is equal to or greater than the specified value and the hammer is rotated idle by the motor, a voltage supplied to the motor is reduced compared with that during normal operation, as a result of the increase in the current flowing through the motor.

Thus, if the control unit is designed to detect the current or the voltage in the motor during the time period of the impact by the hammer, and to integrate the thus-detected current or voltage, the integrated value is increased or decreased according to the count of impacts.

Therefore, in the rotary impact tool of the fifth aspect, the control unit integrates a detection signal of the physical quantity outputted from the impact detection unit, and determines that the count of impacts detected by the impact detection unit has reached the determination count when the integrated value has reached a reference integral value set in advance for impact determination.

Accordingly, it is possible to determine that the count of impacts detected by the impact detection unit has reached the determination count also when the impact detection unit and the control unit are configured as in the rotary impact tool of the fifth aspect.

The rotary impact tool of the fifth aspect may include an input unit to input a thickness of an object to be processed by a rotation of the tool element attached to the attachment unit, and a reference integral value setting unit may be configured to set the reference integral value based on the thickness of the object inputted by the input unit, as in a rotary impact tool of a sixth aspect.

Specifically, according to the rotary impact tool of the sixth aspect, when the drill screw is rotated to be tightened against the object, the rotation speed of the motor can be reduced approximately at the same time as start of tightening of the drill screw without occurrence of the above-described delay, similarly to the rotary impact tool of the fourth aspect.

BRIEF DESCRIPTION OF THE DRAWINGS

FIG. 8A shows a current detection signal, FIG. 8B shows a voltage detection signal, and FIG. 8C shows a rotation detection signal and a rotation speed calculated from the rotation detection signal.

FIG. 12A shows a current detection signal and the detection pulse, and FIG. 12B shows a voltage detection signal and the detection pulse.

EXPLANATION OF REFERENCE NUMERALS

1 . . . rechargeable impact driver, 2 . . . housing, 3 . . . grip portion, 4 . . . motor, 5 . . . hammer case, 6 . . . impact mechanism, 7 . . . spindle, 8 . . . ball bearing, 9 . . . epicyclic gear mechanism, 10 . . . tool body, 11 . . . internal gear, 12 . . . output shaft, 13 . . . pinion, 14 . . . hammer, 15 . . . anvil, 16 . . . coil spring, 17 . . . impact projection, 18 . . . impact arm, 19 . . . chuck sleeve, 20 . . . bearing, 21 . . . trigger switch, 21*a* . . . trigger, 21*b* . . . switch main body, 22 . . . forward/reverse changeover switch, 23 . . . illuminating LED, 24 . . . operation/display panel, 29 . . . battery, 30 . . . battery pack, 40 . . . motor drive unit, 42 . . . drive circuit, Q1-Q6 . . . switching elements, 44 . . . gate circuit, 46 . . . control circuit, 48 . . . regulator, 50 . . . Hall IC, 52 . . . battery voltage detection unit, 54 . . . current detection resistor, 60 . . . impact detection unit, 62 . . . impact detection element, 64 . . . low-pass filter, 66 . . . comparator

MODE FOR CARRYING OUT THE INVENTION

Hereinafter, embodiments of the present invention will be described based on the drawings.

First Embodiment

In the present embodiment, an explanation will be given about a case where the present invention is applied to a rechargeable impact driver 1, which is an example of a rotary impact tool.

Figure 1:
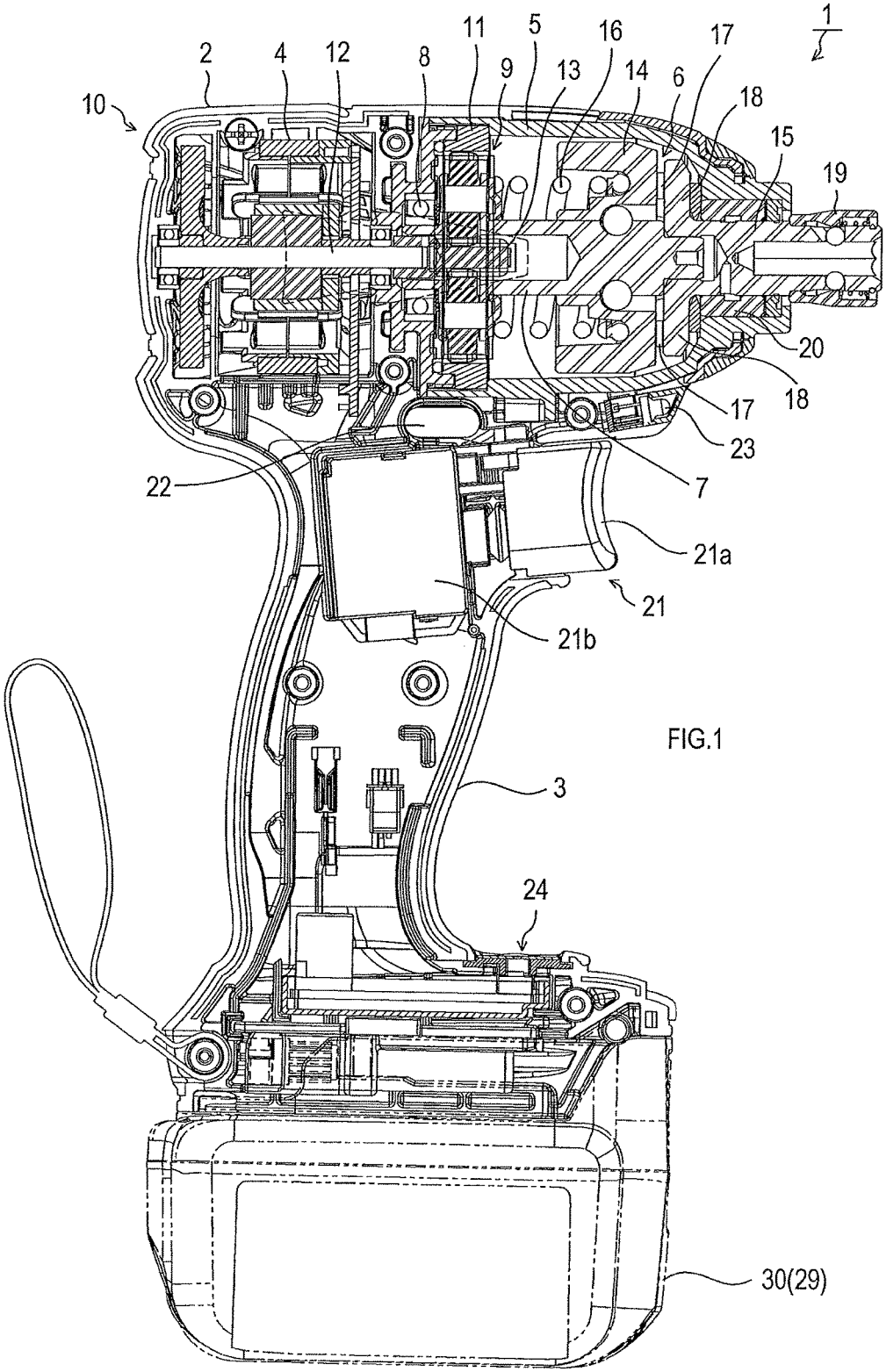
FIG. 1 is a longitudinal sectional view of a rechargeable impact driver according to a first embodiment.

As shown in FIG. 1, the rechargeable impact driver 1 of the present embodiment is configured with a tool body 10 and a battery pack 30 to supply electric power to the tool body 10.

The tool body 10 includes a housing 2 containing a motor 4, an impact mechanism 6, and so on, which are to be described later, and a grip portion 3 provided (on a lower side of FIG. 1) so as to protrude from a lower portion of the housing 2.

The housing 2 contains the motor 4 in a rear portion thereof (on a left side of FIG. 1) and a hammer case 5 having a bell-like shape assembled in front of the motor 4 (on a right side of FIG. 1). The hammer case 5 contains the impact mechanism 6.

Specifically, the hammer case 5 concentrically contains a spindle 7 having a hollow portion formed on a rear end side thereof, and a ball bearing 8 provided in the hammer case 5 on a rear end side thereof pivotally supports a rear end periphery of the spindle 7.

There is provided, in a front portion of the ball bearing 8 in the spindle 7, an epicyclic gear mechanism 9 configured with two epicyclic gears pivotally supported in a point-symmetric manner with respect to an axis of rotation. The epicyclic gear mechanism 9 engages with an internal gear 11 provided on an inner peripheral surface of a rear end side of the hammer case 5.

The epicyclic gear mechanism 9 is designed to engage with a pinion 13 formed at a leading end portion of an output shaft 12 of the motor 4.

The impact mechanism 6 includes the spindle 7, a hammer 14 provided outside the spindle 7, an anvil 15 pivotally supported on a front side of the hammer 14, and a coil spring 16 to bias the hammer 14 forward.

Specifically, the hammer 14 is coupled to the spindle 7 in an integrally rotatable and axially movable manner, and is biased forward (toward the anvil 15) by the coil spring 16.

A leading end portion of the spindle 7 is loosely inserted into a rear end of the anvil 15 coaxially, to thereby be pivotally supported so as to be rotatable.

The anvil 15 is designed to be rotated about an axis thereof by receiving a rotational force and an impact force of the hammer 14. The anvil 15 is supported, so as to be rotatable about the axis thereof and to be axially unmovable, by a bearing 20 provided at a leading end of the housing 2.

Provided at a leading end portion of the anvil 15 is a chuck sleeve 19 for attachment of various tool bits (not shown), such as a driver bit and a socket bit.

The output shaft 12 of the motor 4, the spindle 7, the hammer 14, the anvil 15, and the chuck sleeve 19 are all arranged so as to be coaxial with each other.

On a front end surface of the hammer 14, two impact projections 17, 17 to apply an impact force to the anvil 15 are protrusively provided so as to be circumferentially spaced apart by 180° from each other.

On the other hand, the anvil 15 has, on a rear end side thereof, two impact arms 18, 18 formed so as to be circumferentially spaced apart by 180° from each other. The impact arms 18, 18 are configured to be contactable with the respective impact projections 17, 17 of the hammer 14.

The hammer 14 is biased toward and held at a front end side of the spindle 7 by a biasing force of the coil spring 16, and the respective impact projections 17, 17 of the hammer 14 are thereby brought into contact with the respective impact arms 18, 18 of the anvil 15.

In such a state as above, when the spindle 7 is rotated by a rotational force of the motor 4 via the epicyclic gear mechanism 9, the hammer 14 is rotated together with the spindle 7, and a rotational force of the hammer 14 is transmitted to the anvil 15 via the impact projections 17, 17 and the impact arms 18, 18.

In this way, a driver bit or the like attached to the leading end of the anvil 15 is rotated, to thereby enable screw-tightening.

Then, when a screw is tightened to a specified position and thereby a torque equal to or greater than a specified value is applied externally to the anvil 15, the rotational force (torque) of the hammer 14 applied to the anvil 15 also becomes equal to or greater than a specified value.

In this way, the hammer 14 is moved rearward against the biasing force of the coil spring 16, and the respective impact projections 17, 17 of the hammer 14 come to ride over the respective impact arms 18, 18 of the anvil 15. Specifically, the respective impact projections 17, 17 of the hammer 14 once come off from the respective impact arms 18, 18 of the anvil 15, and rotate idle.

Once the respective impact projections 17, 17 of the hammer 14 ride over the respective impact arms 18, 18 of the anvil 15 as above, the hammer 14 is moved forward again by the biasing force of the coil spring 16, while being rotated together with the spindle 7, and the respective impact projections 17, 17 of the hammer 14 impact the respective impact arms 18, 18 of the anvil 15 in a rotation direction thereof.

Therefore, in the rechargeable impact driver 1 of the present embodiment, each time the torque equal to or greater than the specified value is applied to the anvil 15, an impact by the hammer 14 is repeatedly applied to the anvil 15. Such intermittent application of an impact force of the hammer 14 on the anvil 15 enables additional screw-tightening at a high torque.

Next, the grip portion 3 is designed to be gripped by an operator when using the rechargeable impact driver 1, and a trigger switch 21 is provided above the grip portion 3.

The trigger switch 21 includes a trigger 21*a* to be pull-operated by the operator, and a switch main body 21*b* configured to be turned on/off by the pulling operation of the trigger 21*a* and to cause a resistance value to change in accordance with an operated amount (pulled amount) of the trigger 21*a*.

There is provided above the trigger switch 21 (on a lower end portion of the housing 2) a forward/reverse changeover switch 22 to change over a rotation direction of the motor 4 to either a forward rotation direction (a clockwise direction when seen frontward from a rear end side of the tool, in the present embodiment) or a reverse rotation direction (a rotation direction opposite to the forward rotation direction).

Further provided on a lower front portion of the housing 2 is an illuminating LED 23 to illuminate a forward direction of the rechargeable impact driver 1 with light when the trigger 21*a* is pull-operated.

Also provided on a lower front portion of the grip portion 3 is an operation/display panel 24 to display various set values for the rechargeable impact driver 1, such as a board thickness of an object to which a screw is to be fixed, remaining amount of power of a battery 29 in the battery pack 30, and so on, and to accept changes in the various set values.

The battery pack 30 containing the battery 29 is detachably attached to a lower end of the grip portion 3. The battery pack 30 is attached to the lower end of the grip portion 3 by sliding the battery pack 30 from a front side toward a rear side of the grip portion 3.

The battery 29 contained in the battery pack 30 is a rechargeable battery that can be charged repeatedly, such as a lithium ion rechargeable battery, in the present embodiment.

The motor 4 is a three-phase brushless motor having armature windings of respective phases U, V, and W, in the present embodiment. The motor 4 is provided with a Hall IC 50 (see FIG. 2) to detect a rotational position of the motor 4.

Provided inside the grip portion 3 is a motor drive unit 40 (see FIG. 2) to control driving of the motor 4 by receiving power supply from the battery pack 30.

Figure 2:
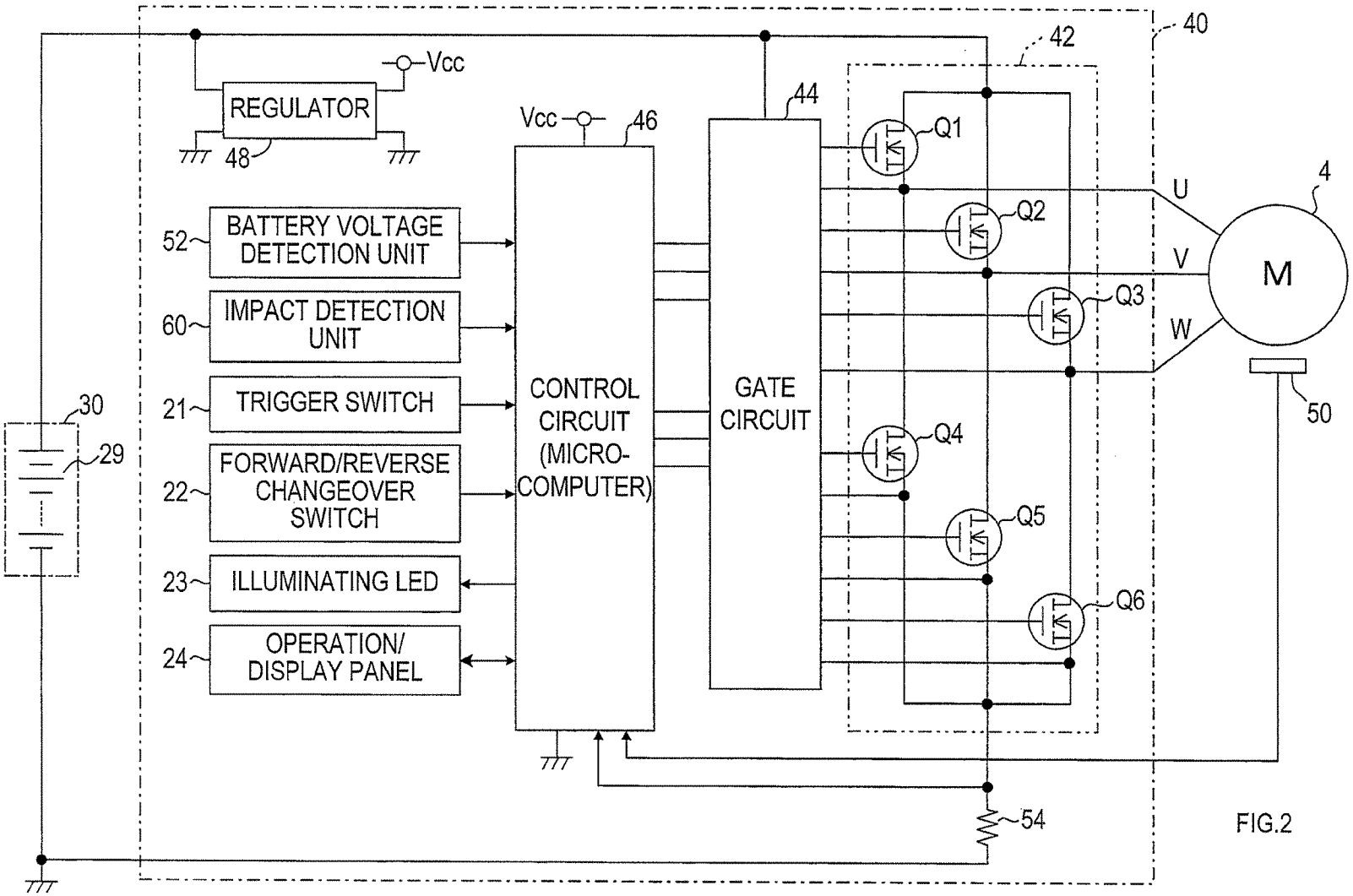
FIG. 2 is a block diagram showing an electrical configuration of a motor drive unit mounted in the rechargeable impact driver.

As shown in FIG. 2, the motor drive unit 40 includes a drive circuit 42, a gate circuit 44, a control circuit 46, and a regulator 48.

The drive circuit 42 is designed to flow current to the windings of the respective phases of the motor 4 by receiving power supply from the battery 29, and is configured as a three-phase full bridge circuit having six switching elements Q1 to Q6 in the present embodiment. Each of the switching elements Q1 to Q6 is a MOSFET in the present embodiment.

In the drive circuit 42, three switching elements Q1 to Q3 are provided, as so-called high side switches, between respective terminals U, V, and W of the motor 4 and a power source line connected to a positive electrode of the battery 29.

The other three switching elements Q4 to Q6 are provided, as so-called low side switches, between the respective terminals U, V, and W of the motor 4 and a ground line connected to a negative electrode of the battery 29.

The gate circuit 44 is designed to turn on/off the respective switching elements Q1 to Q6 in the drive circuit 42 in accordance with a control signal outputted from the control circuit 46, thereby to flow current to the windings of the respective phases of the motor 4 to rotate the motor 4.

Next, the control circuit 46 is configured with a microcomputer including a CPU, a ROM, a RAM, and so on as main components. Connected to the control circuit 46 are the trigger switch 21 (specifically, the switch main body 21*b*), the forward/reverse changeover switch 22, the illuminating LED 23, and the operation/display panel 24 each described above.

In the motor drive unit 40, a current detection resistor 54 to detect a current flowing to the motor 4 is provided in a current conduction path extending from the drive circuit 42 to the negative electrode of the battery 29. A voltage between both ends of the current detection resistor 54 (specifically, a voltage of an opposite side of the negative electrode of the battery 29) is inputted into the control circuit 46 as a current detection signal.

Also provided in the motor drive unit 40 are a battery voltage detection unit 52 to detect a voltage supplied from the battery 29 (a battery voltage), and an impact detection unit 60 to detect an impact by the hammer 14.

Detection signals from the respective detection units 52, 60, and a detection signal from the Hall IC 50 provided to the motor 4 are also inputted into the control circuit 46.

The Hall IC 50 is a known Hall IC that includes three hall elements arranged corresponding to the respective phases of the motor 4 and that generates a rotation detection signal (a pulse signal, see FIG. 8C) each time the motor 4 is rotated by a specified angle.

Figure 3:
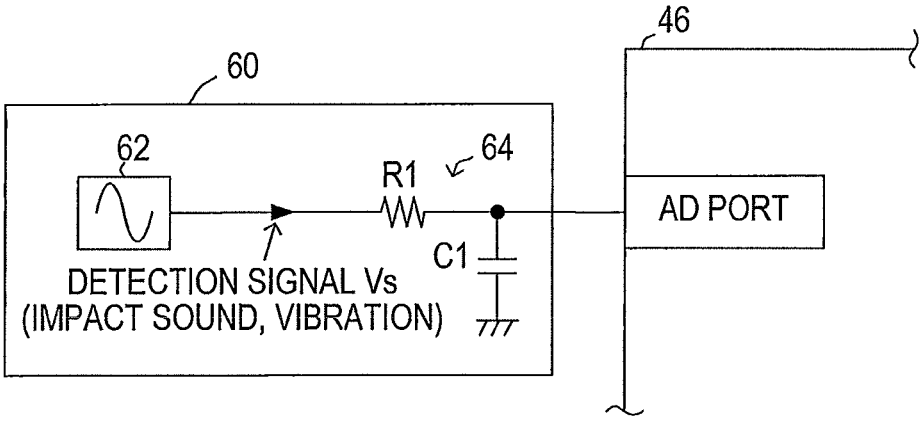
FIG. 3 is a schematic configuration diagram showing a configuration of an impact detection unit provided to the motor drive unit.

As shown in FIG. 3, the impact detection unit 60 includes an impact detection element 62 to detect an impact sound or a vibration generated by an impact on the impact arm 18 of the anvil 15 by the impact projection 17 of the hammer 14. The impact detection element 62 may be configured with a microphone for impact sound detection, a vibration sensor for vibration detection, or the like, for example.

The impact detection unit 60 inputs a detection signal Vs from the impact detection element 62 into an A/D port of the control circuit 46 via a low-pass filter 64 for noise removal configured with a resistor R1 and a capacitor C1.

Figure 4:
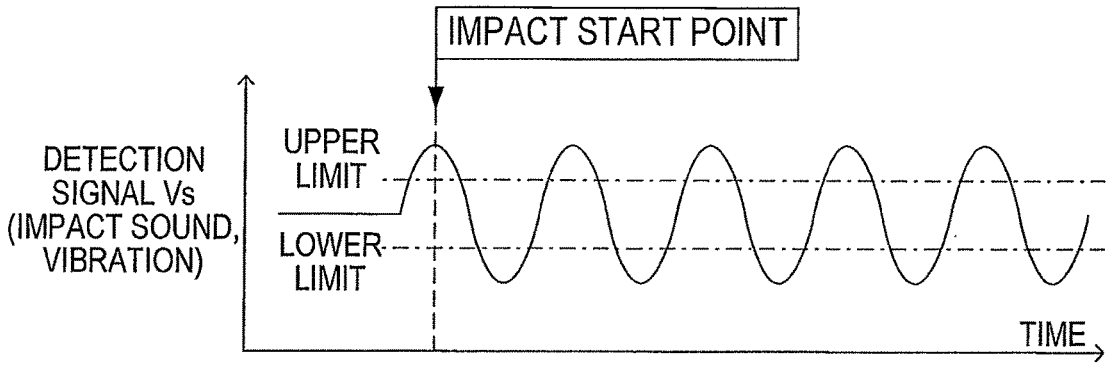
FIG. 4 is a time chart showing a detection signal Vs obtained in the impact detection unit.

Therefore, as shown in FIG. 4, once an impact by the hammer 14 is started, the detection signal Vs, a signal level of which varies with occurrence of the impact, is to be inputted into the control circuit 46 as long as the impact is continued.

Next, when the trigger switch 21 is operated, the control circuit 46 obtains a rotational position and a rotation speed of the motor 4 based on the rotation detection signal from the Hall IC 50, and drives the motor 4 in a specified rotation direction in accordance with a rotation direction setting signal from the forward/reverse changeover switch 22.

When the motor 4 is driven, the control circuit 46 sets a target rotation speed of the motor 4 in accordance with the operated amount (the pulled amount) of the trigger switch 21.

The control circuit 46 sets drive duty ratios for the respective switching elements Q1 to Q6 provided to the drive circuit 42 so that the rotation speed of the motor 4 becomes the target rotation speed, and outputs control signals according to the respective drive duty ratios to the gate circuit 44, to thereby control the rotation speed of the motor 4.

Aside from such a drive control for driving the motor 4, the control circuit 46 executes a control to turn on the illuminating LED 23 during motor driving, as well as a display updating process to display and update the various set values, such as the board thickness of the object, in accordance with an operation command from the operation/display panel 24.

The regulator 48 is designed to generate, by receiving power supply from the battery 29, a constant power-supply voltage Vcc (DC 5 V, for example) required to operate the control circuit 46. The control circuit 46 is operated by being supplied with the power-supply voltage Vcc from the regulator 48.

Next, from among various control processes executed by the control circuit 46, an explanation will be given, with reference to flowcharts shown in FIGS. 5 to 7, about a screw tightening control process executed when the motor 4 is caused to rotate in a forward rotation direction to thereby fix the screw to the object with a tool element, such as a driver bit, attached to the chuck sleeve 19.

Figure 5:
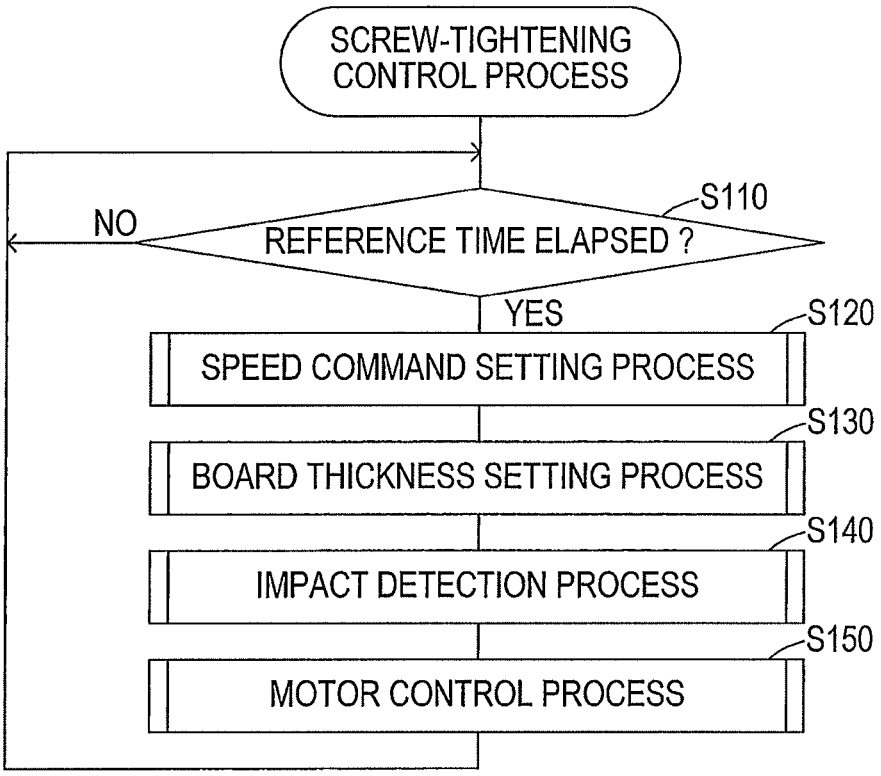
FIG. 5 is a flowchart showing a screw tightening control process executed by a control circuit.

As shown in FIG. 5, in the screw tightening control process, it is first determined in S110 (S represents a "step") whether a specified reference time has elapsed.

If the specified reference time has not elapsed, the process in S110 is executed again to wait the reference time to elapse. When the reference time has elapsed, a speed command setting process in S120, a board thickness setting process in S130, an impact detection process in S140, and a motor control process in S150 are executed sequentially, and the process proceeds to S110 again.

That is, in the screw tightening control process, a series of control processes S120 to S150 are executed periodically upon each elapse of the specified reference time.

Here, in the speed command setting process in S120, based on the operated amount (pulled amount) of the trigger switch 21, the target rotation speed of the motor 4 corresponding to the operated amount is set.

In the board thickness setting process in S130, the board thickness of the object set by a user via the operation/display panel 24 is read from a memory (a non-volatile RAM or a flash memory) in the control circuit 46.

In the impact detection process in S140, based on the detection signal Vs inputted from the impact detection unit 60 and the board thickness read in the board thickness setting process in S130, a screw head is detected to have come into contact with (has been seated on) the object. Then, a seating flag Fi indicating that effect is set to be an ON state.

In the motor control process in S150, driving of the motor 4 is controlled during operation of the trigger switch 21, and such control is switched depending on whether the seating flag Fi is set.

Figure 6:
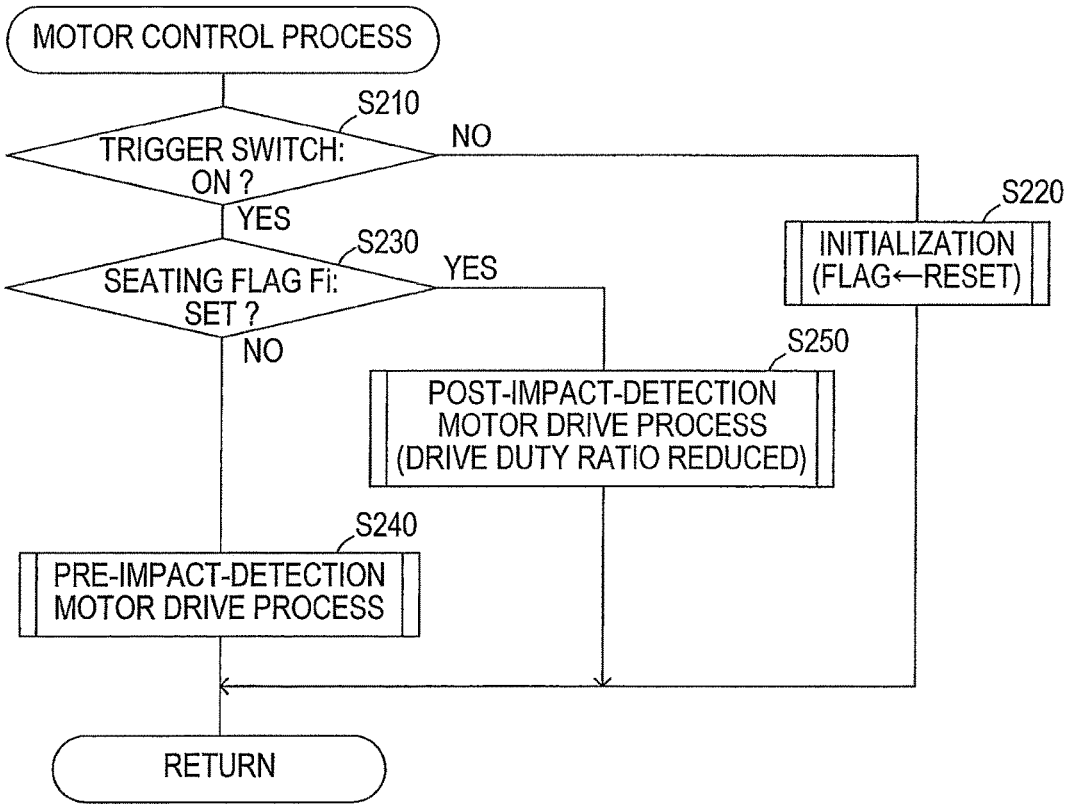
FIG. 6 is a flowchart showing details of a motor control process indicated in FIG. 5.

Specifically, in the motor control process in S150, as shown in FIG. 6, it is first determined in S210 whether the trigger switch 21 (specifically, the switch main body 21*b*) is in an ON state, to thereby determine whether the trigger switch 21 is operated by the user.

If the trigger switch 21 is in an OFF state and is not operated by the user, the process proceeds to S220, and an initialization process (to be described later) to initialize the seating flag Fi, an impact determination flag Fup, and a count of impacts Ci is executed, and the motor control process is terminated.

As a result of the initialization process, the seating flag Fi and the impact determination flag Fup are reset to an OFF state, and the count of impacts Ci is set at the initial value (0).

In contrast, if it is determined in S210 that the trigger switch 21 is in an ON state and is operated by the user, the process proceeds to S230, and it is determined whether the seating flag Fi is set (i.e., whether the seating flag Fi is in an ON state).

If it is determined in S230 that the seating flag Fi is not set, the process proceeds to S240, and after a pre-impact-detection motor drive process is executed, the motor control process is terminated.

The pre-impact-detection motor drive process is executed through steps of: calculating a drive duty ratio required to control the rotation speed of the motor 4 calculated based on the rotation detection signal from the Hall IC 50 at the target rotation speed set in S120; generating control signals based on the calculated drive duty ratio and a rotational position of the motor 4; and outputting the generated control signals to the gate circuit 44.

Specifically, in S240, the respective switching elements Q1 to Q6 in the drive circuit 42 are turned on/off based on the generated control signals via the gate circuit 44, and the motor 4 is thereby caused to rotate at a rotation speed corresponding to the pulled amount of the trigger switch 21.

Next, if it is determined in S230 that the seating flag Fi is set, the process proceeds to S250, and after a post-impact-detection motor drive process is executed, the motor control process is terminated.

The post-impact-detection motor drive process is executed through steps of: generating control signals based on a post-impact-detection drive duty ratio set in advance so as to be less than the drive duty ratio, set in S240, at the time of normal driving (before detection of impact, in other words) and a rotational position of the motor 4; and outputting the generated control signals to the gate circuit 44.

As a result, when the seating flag Fi is set to be an ON state in the impact detection process in S140, a driving force for the motor 4 (a rotational torque, in other words) becomes lower than that before the seating flag Fi is set, and the rotation speed of the motor 4 is also to be lowered accordingly.

Figure 7:
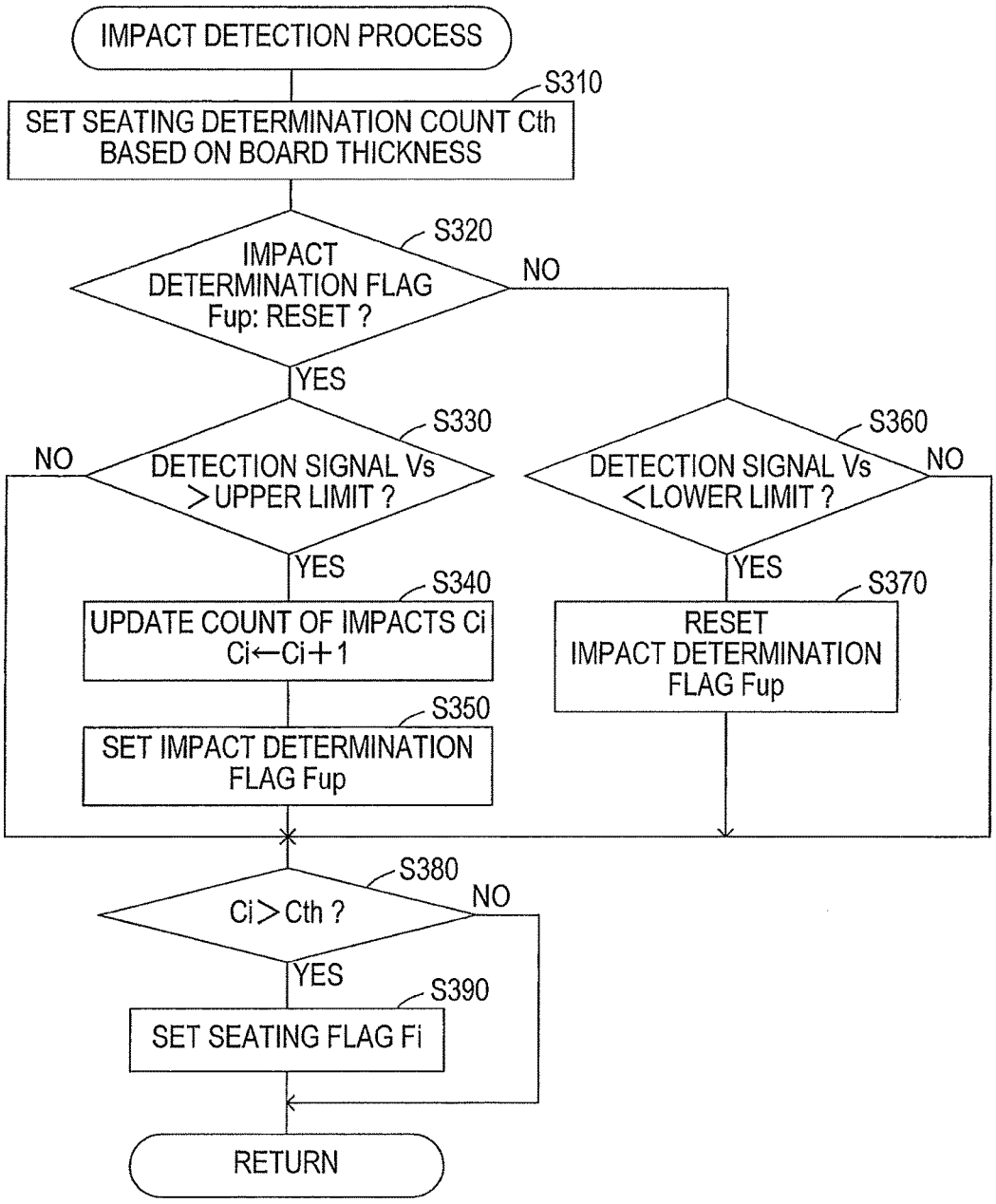
FIG. 7 is a flowchart showing details of an impact detection process indicated in FIG. 5.

Next, the impact detection process in S140 is executed through steps shown in FIG. 7.

Specifically, in the impact detection process, a seating determination count Cth is first set in S310 based on the board thickness of the object read in the board thickness setting process in S130.

The seating determination count Cth is used to determine that the screw head has been seated on the object from the count of impacts detected by the impact detection unit 60 (the count of impacts Ci to be described later). The thicker the board thickness is, the greater value the seating determination count Cth is set at.

Next, it is determined in S320 whether the impact determination flag Fup has been reset (i.e., whether the impact determination flag Fup is in an OFF state). If the impact determination flag Fup has been reset, the process proceeds to S330. If the impact determination flag Fup has not been reset, the process proceeds to S360.

In S330, it is determined whether the detection signal Vs for an impact sound or a vibration inputted from the impact detection unit 60 has exceeded an upper limit set in advance (see FIG. 4), and thereby it is determined whether an impact on the anvil 15 by the hammer 14 has occurred.

If it is determined in S330 that the detection signal Vs has not exceeded the upper limit, the process proceeds to S380. If it is determined in S330 that the detection signal Vs has exceeded the upper limit and that an impact on the anvil 15 by the hammer 14 has occurred, the process proceeds to S340.

In S340, the count of impacts Ci is incremented (+1). Then, in subsequent S350, the impact determination flag Fup is set to an ON state, and the process proceeds to S380.

On the other hand, in S360, it is determined whether the detection signal Vs has fallen below a lower limit set in advance (see FIG. 4). If the detection signal Vs has fallen below the lower limit, after the impact determination flag Fup is reset to an OFF state in S370, the process proceeds to S380. If the detection signal Vs has not fallen below the lower limit, the process proceeds to S380 with no action taken.

It is determined in S380 whether the count of impacts Ci, which is incremented in S340 when it is determined in S330 that an impact has occurred, has exceeded the seating determination count Cth set based on the board thickness of the object in S310.

If it is determined in S380 that the count of impacts Ci has exceeded the seating determination count Cth, it is determined that the screw head has come into contact with (has been seated on) the object by the rotation of the motor 4, and after the seating flag Fi is set in S390, the impact detection process is terminated.

If it is determined in S380 that the count of impacts Ci has not exceeded the seating determination count Cth, the impact detection process is terminated with no action taken.

As explained hereinabove, in the rechargeable impact driver 1 of the present embodiment, the control circuit 46 counts the count of impacts Ci on the anvil 15 by the hammer 14 based on the detection signal Vs from the impact detection unit 60.

The control circuit 46 reduces the drive duty ratio of the motor 4 (the rotation speed of the motor 4, in other words) in the motor control process to be lower than that during normal operation, by setting the seating flag Fi when the counted count of impacts Ci has exceeded the seating determination count Cth.

Therefore, according to the rechargeable impact driver 1 of the present embodiment, during fixing of the drill screw to the object, even when an impact on the anvil 15 by the hammer 14 is performed in the internal thread forming step, in which the head of the drill screw has yet to come into contact with (has not been seated on) the object, the driving force for the motor 4 (and thus, the rotation speed of the motor 4) can be inhibited from being reduced by such an impact.

Thus, according to the rechargeable impact driver 1 of the present embodiment, during fixing of the drill screw to the object, the driving force for the motor 4 can be inhibited from being reduced to thereby reduce the rotation speed of the motor 4 during the time before the head of the drill screw is brought into contact with the object.

Therefore, according to the rechargeable impact driver 1 of the present embodiment, the time required to fix the drill screw to the object can be shortened compared with that described in Patent Document 1 and, as a result, usability of the rotary impact tool for the user can be improved.

In addition, according to the rechargeable impact driver 1 of the present embodiment, since the driving force for the motor 4 is reduced when the count of impacts Ci by the hammer 14 has exceeded the seating determination count Cth, it is possible to reduce the rotation speed of the motor 4 to less than that during normal operation when the head of the drill screw is brought into contact with the object and tightening of the drill screw becomes necessary.

When a normal screw, not the drill screw, is to be fixed to the object, it is possible to reduce the driving force for the motor 4 to thereby reduce the rotation speed of the motor 4, although such reduction is delayed by the count of impacts corresponding to an impact determination count.

Therefore, according to the rechargeable impact driver 1 of the present embodiment, it is possible to inhibit the screw head from being damaged due to excessive impact force applied to the screw head by the driver bit, which is a tool element.

Moreover, according to the rechargeable impact driver 1 of the present embodiment, the seating determination count Cth is set according to the thickness of the object to which the screw is fixed. Therefore, the driving force for the motor 4 (the rotation speed of the motor 4, in other words) can be switched at a timing when the head of the drill screw is brought into contact with the object.

Furthermore, according to the rechargeable impact driver 1 of the present embodiment, the thickness of the object can be arbitrarily set by the operation of the operation/display panel 24 by the user. Therefore, during fixing of a normal screw, not the drill screw, to the object, if the user sets the thickness of the object at zero or the lowest value, it becomes possible to reduce the driving force for the motor 4 immediately after the screw head has come into contact with (has been seated on) the object, and the delay in such switching can thereby be inhibited.

In the present embodiment, the chuck sleeve 19 corresponds to an example of an attachment unit of the present invention, the operation/display panel 24 corresponds to an example of an input unit of the present invention, and the drive circuit 42 corresponds to an example of a drive unit of the present invention.

The control circuit 46 to execute the screw tightening control process corresponds to an example of a control unit and a determination count setting unit of the present invention. Especially, in the screw tightening control process executed by the control circuit 46, the impact detection process and the motor control process function as an example of the control unit of the present invention, and the process of S310 therein functions as an example of the determination count setting unit of the present invention.

Modified Example

The present embodiment has been explained as a configuration in which the impact detection unit 60 is provided with the impact detection element 62 to detect an impact sound or a vibration, and the control circuit 46 detects the impact when the signal level of the detection signal Vs obtained via the impact detection element 62 has exceeded the upper limit.

However, in order for the control circuit 46 to detect an impact, a current detection signal inputted from the current detection resistor 54 (see FIG. 8A), a voltage detection signal inputted from the battery voltage detection unit 52 (see FIG. 8B), or a rotation detection signal inputted from the Hall IC 50 (see FIG. 8C) may be employed.

Specifically, when the hammer 14 impacts the anvil 15, a torque applied externally to the anvil 15 is increased, and a load applied to the motor 4 is thereby increased. Then, the load applied to the motor 4 is reduced by the idle rotation of the hammer.

Thus, rotation variation in the motor 4 occurs, which causes changes in the current flowing through the motor 4, the battery voltage applied to the motor 4, and the rotation speed of the motor 4.

Figure 8A:
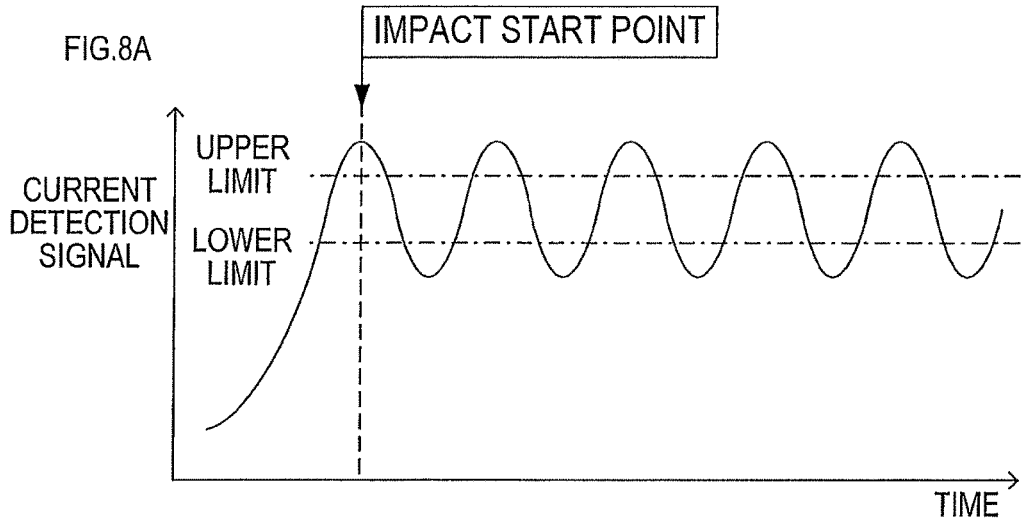
FIGS. 8A to 8C are time charts showing modified examples of the detection signals used for impact detection.

In a case where the impact on the anvil 15 by the hammer 14 occurs repeatedly, the current detection signal inputted from the current detection resistor 54 rises to higher than that during normal motor driving as shown in FIG. 8A, and varies according to the impact by the hammer 14.

Therefore, when detecting an impact using the current detection signal, in the impact detection process shown in FIG. 7, it may be determined in S330 whether the current detection signal has exceeded an upper limit set in advance, and it may be determined that an impact by the hammer 14 has occurred when the current detection signal has exceeded the upper limit.

In this case, it may be determined in S360 whether the current detection signal has fallen below a lower limit set in advance, and the impact determination flag Fup may be reset in S370 when the current detection signal has fallen below the lower limit.

Further, in this case, the current detection signal may be inputted into the control circuit 46 after removing a noise component therefrom through the low-pass filter, similarly to the detection signal Vs.

Figure 8B:
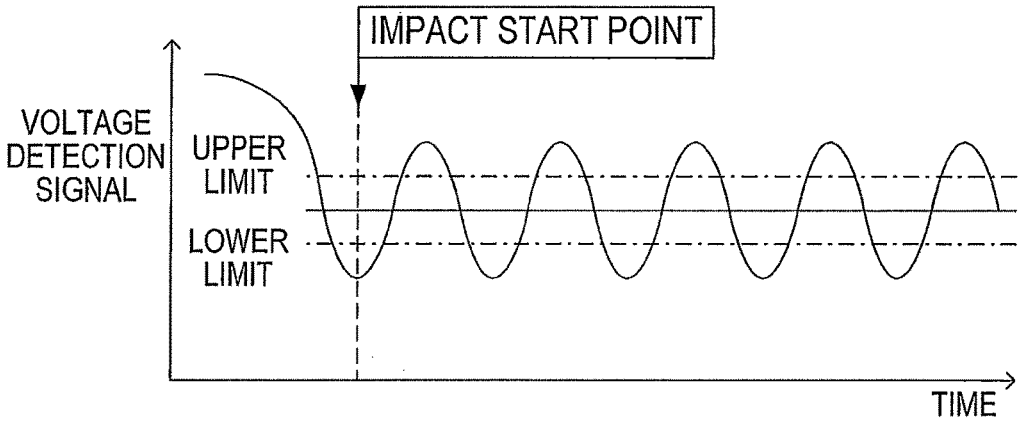

On the other hand, in a case where the impact on the anvil 15 by the hammer 14 occurs repeatedly, the voltage detection signal inputted from the battery voltage detection unit 52 falls to be lower than that during normal motor driving as shown in FIG. 8B, and varies according to the impact by the hammer 14.

Therefore, when detecting an impact using the voltage detection signal, in the impact detection process shown in FIG. 7, it may be determined in S330 whether the voltage detection signal has fallen below a lower limit set in advance, and it may be determined that the impact by the hammer 14 has occurred when the voltage detection signal has fallen below the lower limit.

In this case, it may be determined in S360 whether the voltage detection signal has exceeded an upper limit set in advance, and the impact determination flag Fup may be reset in S370 when the voltage detection signal has exceeded the upper limit.

Further, in this case, the voltage detection signal may be inputted into the control circuit 46 after removing a noise component therefrom through the low-pass filter, similarly to the detection signal Vs and the current detection signal.

Figure 8C:
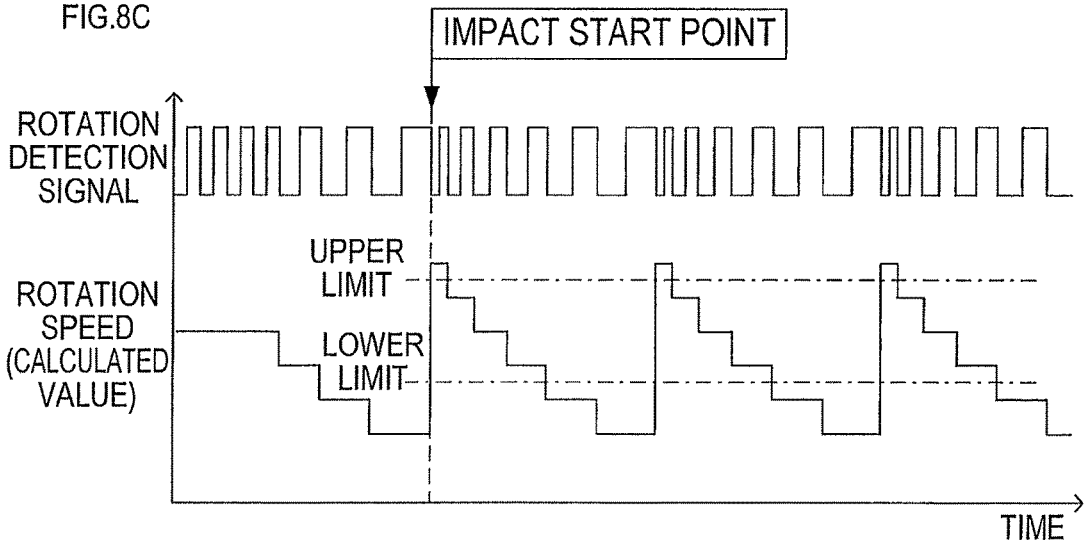

Next, in a case where the impact on the anvil 15 by the hammer 14 occurs repeatedly, the rotation detection signal inputted from the Hall IC 50 varies in pulse width according to rotation variation of the motor 4 as shown in FIG. 8C. Thus, the rotation speed of the motor 4 calculated from the pulse width also varies periodically.

Therefore, when detecting an impact using the rotation detection signal, in the impact detection process shown in FIG. 7, it may be determined in S330 whether the rotation speed of the motor 4 obtained from the pulse width of the rotation detection signal has exceeded an upper limit set in advance, and it may be determined that the impact by the hammer 14 has occurred when the rotation speed has exceeded the upper limit.

In this case, it may be determined in S360 whether the rotation speed of the motor 4 obtained from the pulse width of the rotation detection signal has fallen below a lower limit set in advance, and the impact determination flag Fup may be reset in S370 when the rotation speed of the motor 4 has fallen below the lower limit.

Alternatively, when detecting an impact in the control circuit 46, it is possible not to employ one of: an impact sound or a vibration detected via the impact detection unit 60; a current detected via the current detection resistor 54; a voltage detected via the battery voltage detection unit 52; and a rotation speed obtained from the rotation detection signal from the Hall IC 50, but to employ a plurality of physical quantities selected from these physical quantities.

In this case, a configuration may be adopted in which counting processes to count the count of impacts Ci in S320-S370 are each executed more than once using a plurality of physical quantities, and the seating flag Fi is set when any one of the counts of impacts Ci-1, Ci-2, . . . obtained in such a plurality of counting processes (or all of the plurality of counts of impacts selected from the plurality of counts of impacts Ci-1, Ci-2, . . . ) has exceeded the seating determination count Cth.

Second Embodiment

Next, an explanation will be given about a second embodiment of the present invention.

A rotary impact tool of the present embodiment is basically configured in a manner similar to that in the rechargeable impact driver 1 of the first embodiment. What are different from the first embodiment are a circuit configuration of the impact detection unit 60 and an impact detection process executed by the control circuit 46.

Thus, in the present embodiment, differences from the first embodiment will be described.

Figure 9:
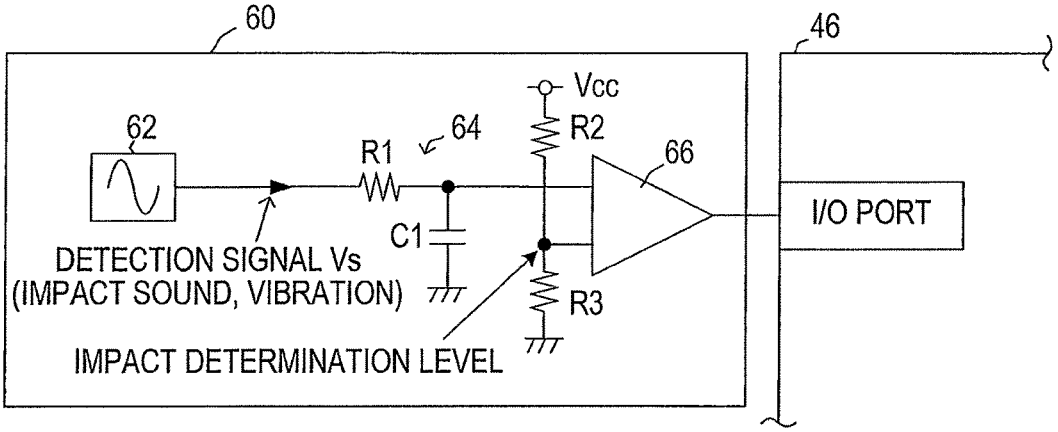
FIG. 9 is a schematic configuration diagram showing a configuration of an impact detection unit according to a second embodiment.

As shown in FIG. 9, there is provided in the impact detection unit 60 of the present embodiment a comparator 66 in addition to the impact detection element 62 and the low-pass filter 64.

The comparator 66 is a comparison circuit to compare an impact determination level obtained by voltage division of the power-supply voltage Vcc via resistors R2 and R3, and the detection signal Vs that has passed through the low-pass filter 64.

Figure 10:
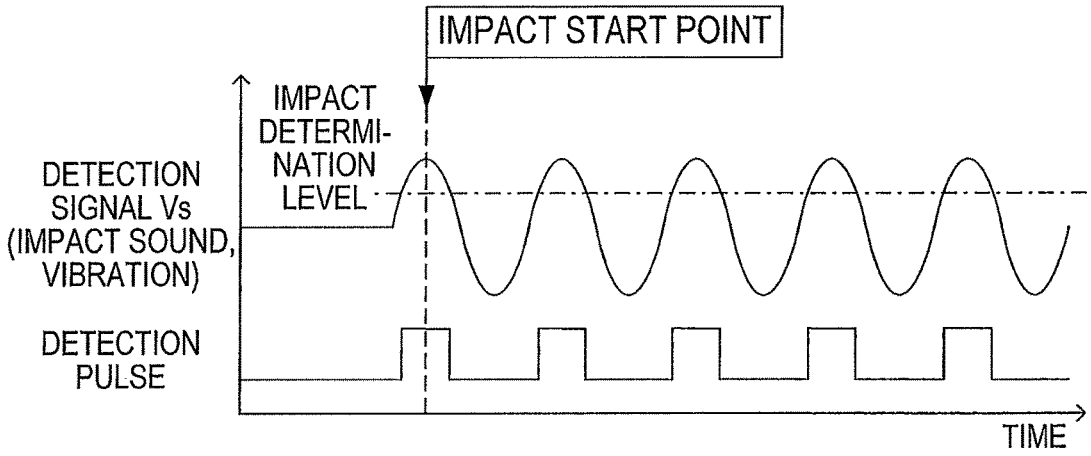
FIG. 10 is a time chart showing a detection pulse obtained in the impact detection unit.

As shown in FIG. 10, the comparator 66 generates a detection pulse that becomes high level when the detection signal Vs is over an impact determination level, and inputs the detection pulse into an I/O port of the control circuit 46.

Then, the control circuit 46 counts, by a known edge interrupt, edges (rising edges or falling edges) of the detection pulse inputted from the comparator 66 into the I/O port, and sets the seating flag Fi when the counted number of edge interrupts (count of edge interrupts) has exceeded the seating determination count Cth.

Figure 11:
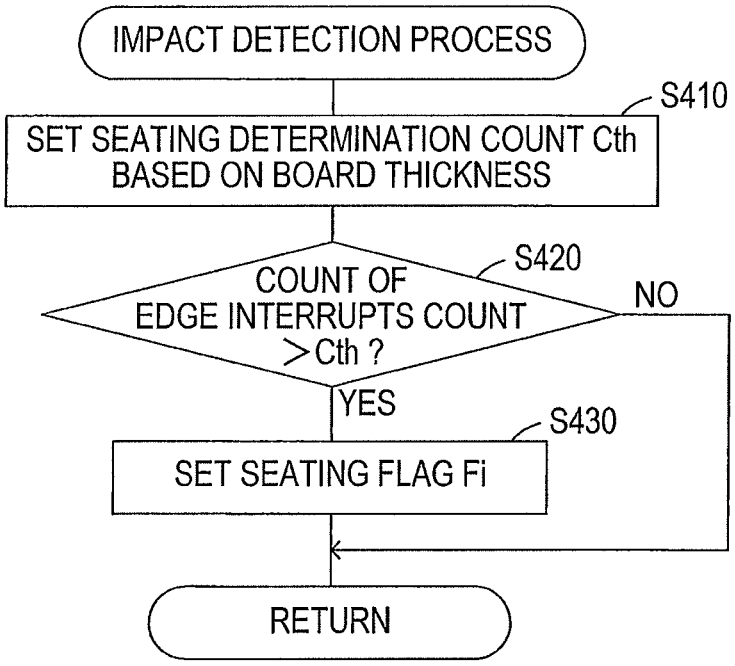
FIG. 11 is a flowchart showing an impact detection process according to the second embodiment.

Specifically, in the control circuit 46, the impact detection process is executed, as shown in FIG. 11, through steps such as: setting the seating determination count Cth based on the board thickness of the object (S410), determining whether the count of edge interrupts by the detection pulse has exceeded the seating determination count Cth (S420), and setting the seating flag Fi when the count of edge interrupts has exceeded the seating determination count Cth (S430).

Therefore, according to the rechargeable impact driver 1 of the present embodiment, effects similar to those described in the first embodiment can be obtained.

Moreover, in the present embodiment, the comparator 66 is provided to the impact detection unit 60, and a determination of whether an impact has occurred is designed to be made by the impact detection unit 60. Thus, it is possible to simplify the impact detection process compared with that in the first embodiment, to thereby reduce a processing load of the control circuit 46.

Modified Example

In the present embodiment, the impact detection unit 60 has been described as being provided with the comparator 66 and generating the detection pulse for impact. However, as shown in FIGS. 12A and 12B, the detection pulse may be designed to be generated from the current detection signal inputted from the current detection resistor 54 or the voltage detection signal inputted from the battery voltage detection unit 52.

Figure 12A:
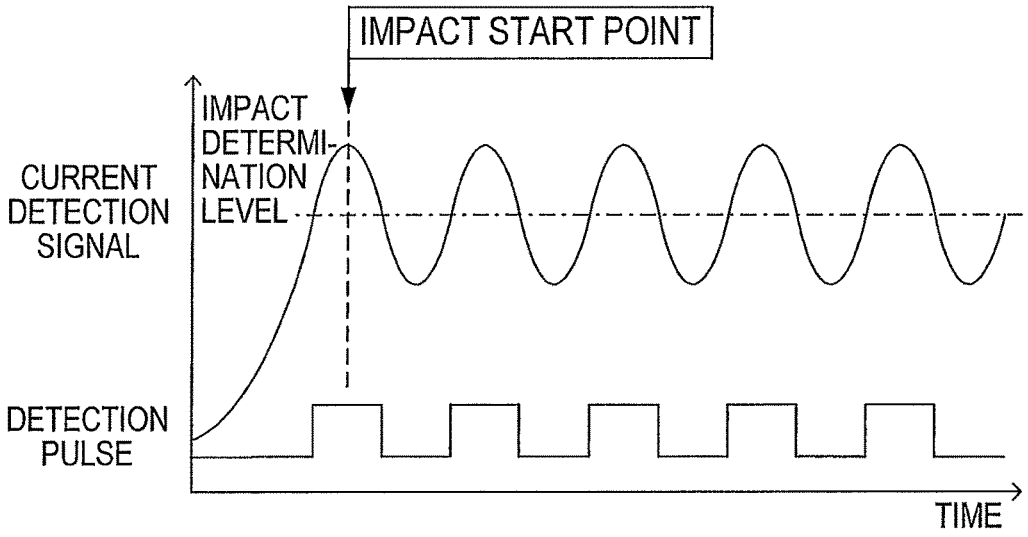
FIGS. 12A and 12B are time charts explaining modified examples of a method for generating a detection pulse.

As shown in FIG. 12A, when the detection pulse is to be generated from the current detection signal, it is only necessary to provide a comparator, as a comparison circuit, that compares the current detection signal with the impact determination level and generates the detection pulse (high level) when the current detection signal has exceeded the impact determination level.

Figure 12B:
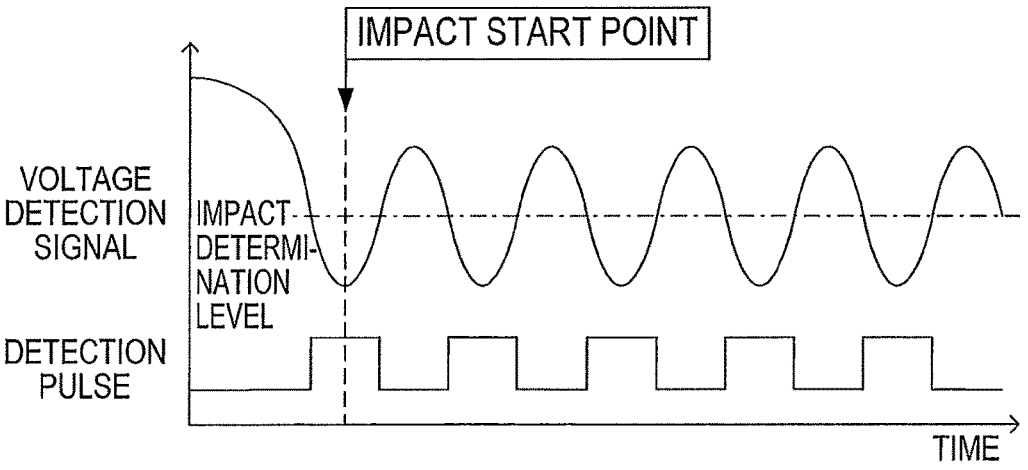

As shown in FIG. 12B, when the detection pulse is to be generated from the voltage detection signal, it is only necessary to provide a comparator, as a comparison circuit, that compares the voltage detection signal with the impact determination level and generates the detection pulse (high level) when the voltage detection signal has fallen below the impact determination level.

Third Embodiment

Next, an explanation will be given about a third embodiment of the present invention.

A rotary impact tool of the present embodiment is basically configured in a manner similar to the rechargeable impact driver 1 of the first embodiment. What is different from the first embodiment is an impact detection process executed by the control circuit 46.

Figure 13:
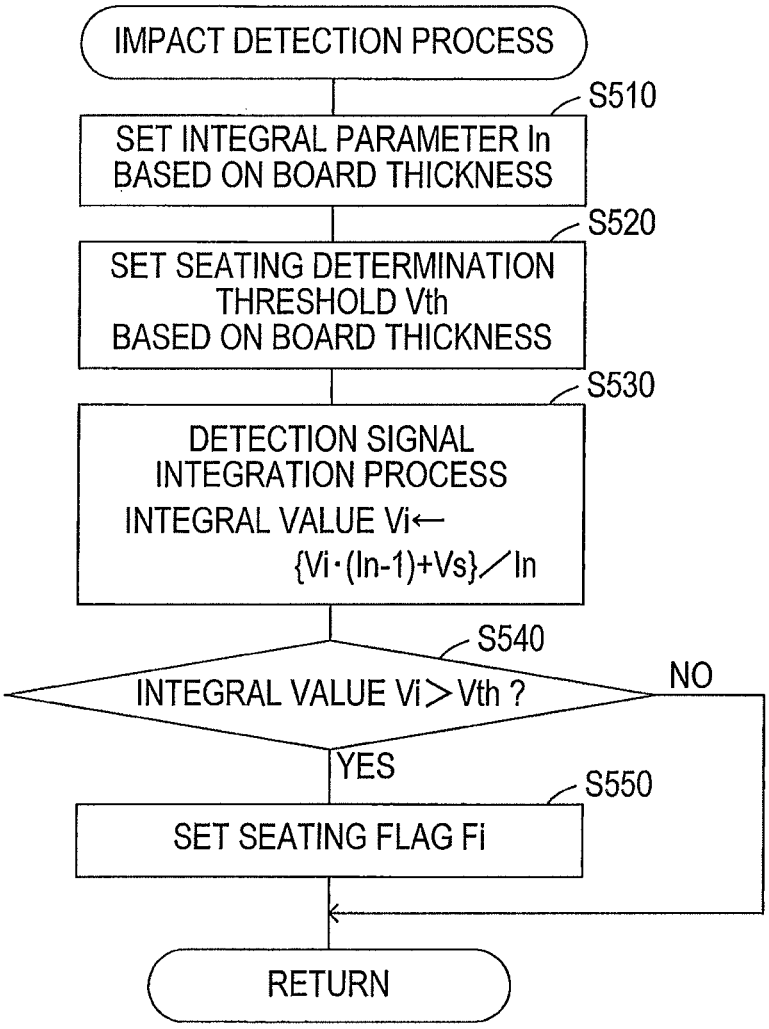
FIG. 13 is a flowchart showing an impact detection process according to a third embodiment.

As shown in FIG. 13, in the impact detection process of the present embodiment, an integral parameter In, which is used to calculate an integral value Vi of the detection signal Vs in a process to be described later, is first set in S510 based on the board thickness of the object such that the thicker the board thickness is, the greater value the integral parameter In is.

In subsequent S520, a seating determination threshold Vth is set based on the board thickness of the object such that the thicker the board thickness is, the greater value the seating determination threshold Vth is. This process in S520 functions as an example of a reference integral value setting unit of the present invention.

Then, in S530, the detection signal Vs is retrieved from the impact detection unit 60, and the integral value Vi of the detection signal Vs is calculated using the integral parameter In set in S510.

Next, it is determined in S540 whether the integral value Vi calculated in S530 has exceeded the seating determination threshold Vth.

If the integral value Vi has not exceeded the seating determination threshold Vth, the impact detection process is terminated with no action taken. If the integral value Vi has exceeded the seating determination threshold Vth, the seating flag Fi is set in S550 and, then, the impact detection process is terminated.

Specifically, the detection signal Vs obtained in the impact detection unit 60 varies according to an impact sound or a vibration. When an impact by the hammer 14 has not occurred, the amplitude is approximately zero, and when an impact by the hammer 14 has occurred, the amplitude varies between positive and negative centering at the zero point.

Thus, the present embodiment is designed such that an absolute value of the detection signal Vs is weighted-averaged, as it is called, (weighted and averaged, in other words) to thereby obtain the integral value Vi that increases in accordance with the count of continuous occurrences of impact and, when the integral value Vi has reached the seating determination threshold Vth as a reference integral value, it is determined that the head of the torque screw has come into contact with (has been seated on) the object.

The weighted-averaging (weighting and averaging) to obtain the integral value Vi is performed, each time S530 is executed, by updating the integral value Vi periodically using an arithmetic expression "$Vi \leftarrow \{Vi\ (In-1)+Vs\}/In$" with parameters of the current integral value Vi (initial value: 0) and the current integral parameter In, for example.

As a result, also in the rechargeable impact driver 1 of the present embodiment, effects similar to those described in the first embodiment can be obtained.

The integral value Vi used for seating determination may be calculated from a signal level of the current detection signal inputted from the current detection resistor 54 or a signal level of the voltage detection signal inputted from the battery voltage detection unit 52.

Specifically, when the integral value Vi is calculated from the current detection signal, it is only necessary to weighted-average the signal level of the current detection signal as it is, and when the integral value Vi is calculated from the voltage detection signal, it is only necessary to weighted-average a decrement of the voltage detection signal from a normal level thereof.

Furthermore, when the seating determination is performed using the integral value Vi that increases with occurrence of an impact, the integral value Vi is not necessarily required to be calculated by the weighted-averaging as in the present embodiment, and a time when the detection signal has exceeded the impact determination level may be added, for example.

The embodiments of the present invention have been described so far, but the present invention is not limited to the above embodiments and can be implemented in various forms within a scope not departing from the spirit of the present invention.

For example, in the above embodiments, the control circuit 46 has been described as being configured with a microcomputer, but the control circuit 46 may be configured with an ASIC (Application Specific Integrated Circuits) and a programmable logic device such as an FPGA (Field Programmable Gate Array), for example.

The various control processes executed by the control circuit 46 are achieved by execution of a program by the CPU provided to the control circuit 46. The program may be written to a memory (a ROM or a non-volatile RAM) in the control circuit 46, or may be recorded on a recording medium, data in which can be read by the control circuit 46. As the recording medium, a portable semiconductor memory (such as a USB memory, a Memory Card (registered trademark)) may be employed.

The present invention is not limited to the rechargeable impact driver 1 of the above embodiments, and can be applied to any rotary impact tool as long as it includes an impact mechanism driven by a motor.

Furthermore, although the motor 4 has been described as being configured with a three-phase brushless motor in the above embodiments, any motor may be employed as long as it is capable of rotationally driving the impact mechanism 6.

Specifically, the rotary impact tool of the present invention may be applied not only to a battery-type one but also to a tool that receives power supply through a cord, or may be configured to rotationally drive the tool element by an AC motor, for example.

Each of the switching elements Q1 to Q6 provided to the drive circuit 42 may be a switching element other than a MOSFET (a bipolar transistor, for example).

Moreover, although the battery 29 has been described as being a lithium-ion rechargeable battery in the above embodiments, just by way of example, the battery 29 may be other type of rechargeable battery, such as a nickel hydride rechargeable battery or a nickel cadmium storage battery.

The invention claimed is:

1. A rotary impact tool comprising:

a motor;

an impact mechanism comprising:

a hammer configured to be rotated by a rotational force of the motor;

an anvil configured to be rotated by receiving a rotational force of the hammer; and an attachment unit configured to attach a tool element to the anvil, wherein the impact mechanism is configured such that, when a torque equal to or greater than a specified value is applied externally to the anvil, the hammer comes off the anvil to rotate idle, and impacts the anvil in a rotation direction thereof;

a drive unit configured to drive the motor in accordance with an external drive command;

an impact detection unit configured to detect an impact on the anvil by the hammer, wherein the impact detection unit is configured to detect at least one physical quantity selected from:

a current sent to or received from the motor and varying according to the impact;

a voltage measured across at least a portion of the motor and varying according to the impact; and a rotation speed of the motor varying according to the impact; and a control unit configured to reduce a driving force for the motor caused by the drive unit when a count of impacts detected by the impact detection unit has reached a determination count set in advance, which is a value greater than one, wherein the control unit is configured to integrate a detection signal of the physical quantity outputted from the impact detection unit, and to determine that the count of impacts detected by the impact detection unit has reached the determination count when the integrated value has reached a reference integral value set in advance for impact determination.

2. The rotary impact tool according to claim 1, wherein the control unit is configured to determine that the hammer has impacted the anvil and to count the detected count of impacts when the physical quantity detected by the impact detection unit varies either toward an increase or toward a decrease to respectively either exceed a threshold set in advance for impact determination or fall below a threshold set in advance for impact determination.

3. The rotary impact tool according to claim 2, wherein the control unit comprises a comparison circuit configured to compare the physical quantity detected by the impact detection unit with the threshold set in advance for impact determination and to output a determination signal when the physical quantity has exceeded the threshold, and wherein the control unit is configured to count a count of outputs of the determination signal from the comparison circuit as the detected count of impacts.

4. The rotary impact tool according to claim 1, comprising:

an input unit configured to input a thickness of an object to be processed by a rotation of the tool element attached to the attachment unit; and a determination count setting unit configured to set the determination count based on the thickness of the object inputted by the input unit such that the thicker the thickness of the object is, the greater the value of the determination count is.

5. The rotary impact tool according to claim 1, further comprising:

an input unit configured to input a thickness of an object to be processed by a rotation of the tool element attached to the attachment unit; and a reference integral value setting unit configured to set the reference integral value based on the thickness of the object inputted by the input unit.

6. The rotary impact tool according to claim 1, wherein the control unit is configured to reduce the driving force to thereby reduce a rotation speed of the motor.

7. The rotary impact tool according to claim 1, wherein the determination count is set based on a thickness of an object to be processed by a rotation of the tool element attached to the attachment unit.

8. The rotary impact tool according to claim 1, wherein the impact detection unit is configured to detect the rotation speed based on a pulse width of a pulse signal, the pulse signal being generated each time the motor rotates by a specified angle.

9. A rotary impact tool comprising:

an impact detection unit; and a control circuit, wherein the control circuit includes a non-transitory computer readable storage medium containing instructions that, when executed by one or more processors, cause at least the following actions:

perform a speed command setting process, perform a board thickness setting process, perform an impact detection process, and perform a motor control process, wherein performing the impact detection process includes:

set a seating determination count based at least partly on a board thickness;

determine that an impact determination flag is reset;

determine that a detection signal indicates an impact;

increment a count of impacts;

set the impact determination flag;

determine that the count of impacts is greater than the seating determination count; and set a seating flag.

10. The rotary impact tool of claim 9, wherein performing the speed command setting process includes:

determine an operated amount of an input control; and determine a normal target rotation speed for a motor, based at least partly upon the operated amount.

11. The rotary impact tool of claim 10, wherein the operated amount is a pulled amount of a trigger.

12. The rotary impact tool of claim 9, wherein performing the board thickness setting process includes:

receive a board thickness value.

13. The rotary impact tool of claim 9, wherein determining that the detection signal indicates an impact includes:

detecting an edge interrupt generated by the detection signal.

14. The rotary impact tool of claim 9, wherein performing the motor control process includes:

determine that a trigger switch is ON;

determine that a seating flag is set;

determine a reduced target rotational speed that is less than a normal target rotational speed, wherein the normal target rotational speed is based on a pulled amount of a trigger; and drive a motor based upon the reduced target rotational speed.

15. A rotary impact tool comprising:

an impact detection unit; and a control circuit, wherein the control circuit includes a non-transitory computer readable storage medium containing instructions that, when executed by one or more processors, cause at least the following actions:

perform a speed command setting process, perform a board thickness setting process, perform an impact detection process, and perform a motor control process, wherein performing the speed command setting process includes:

determine an operated amount of an input control; and determine a normal target rotation speed for a motor, based at least partly upon the operated amount, wherein the operated amount is a pulled amount of a trigger, wherein performing the board thickness setting process includes:

receive a board thickness value, wherein performing the impact detection process includes:

set a seating determination count based on a board thickness;

determine that an impact determination flag is reset;

determine that a detection signal indicates an impact;

increment a count of impacts;

set the impact determination flag;

determine that the count of impacts is greater than the seating determination count; and set a seating flag, wherein determining that the detection signal indicates an impact includes:

detecting an edge interrupt generated by the detection signal, and wherein performing the motor control process includes:

determine that a trigger switch is ON;

determine that a seating flag is set;

determine a reduced target rotational speed that is less than a normal target rotational speed, wherein the normal target rotational speed is based on a pulled amount of a trigger; and drive a motor based upon the reduced target rotational speed.

16. The rotary impact tool of claim 15, wherein performing the impact detection process includes:

set an integral parameter based at least partly on a board thickness;

set a seating determination threshold based at least partly on the board thickness;

calculate a new integral value;

determine that the new integral value is greater than the seating determination threshold; and set a seating flag.

17. The rotary impact tool of claim 16, wherein the integral value is calculated by the following equation:

$$Vi \leftarrow \{Vi \cdot (In-1)+Vs\}/In,$$

where Vi is the integral value, In is the integral parameter and Vs is the detection signal.

* * * * *